United States Patent [19]

Hanson et al.

[11] 4,337,143

[45] Jun. 29, 1982

[54] PROCESS FOR OBTAINING PRODUCTS FROM TAR SAND

[75] Inventors: Francis V. Hanson; Jan D. Miller; Alex G. Oblad, all of Salt Lake City, Utah

[73] Assignee: University of Utah, Salt Lake City, Utah

[21] Appl. No.: 155,257

[22] Filed: Jun. 2, 1980

[51] Int. Cl.[3] ..... C10G 1/02; C10G 1/04

[52] U.S. Cl. ..... 208/11 R; 208/11 LE

[58] Field of Search ..... 208/11 R, 11 LE

[56] References Cited

U.S. PATENT DOCUMENTS

| | | | |
|---|---|---|---|
| 3,261,775 | 7/1966 | Blaser | 208/11 R |
| 3,320,152 | 5/1967 | Nathan | 208/11 R |
| 3,466,240 | 9/1969 | Steinmetz | 208/11 LE |
| 3,518,181 | 6/1970 | Tse | 208/11 R |
| 4,120,776 | 10/1978 | Miller | 208/11 LE |
| 4,161,442 | 7/1979 | Audeh | 208/11 R |

FOREIGN PATENT DOCUMENTS

| | | | |
|---|---|---|---|
| 530920 | 9/1956 | Canada | 208/11 R |

*Primary Examiner*—T. M. Tufariello

*Attorney, Agent, or Firm*—H. Ross Workman; J. Winslow Young; Allen R. Jensen

[57] ABSTRACT

A novel thermal process for recovering hydrocarbon and other products from tar sand. The process includes blending tar sand with a bitumen-rich concentrate while heating the same with a hot, burnt sand. The products are recovered by passing the combined feed through a fluidized bed and selectively controlling the temperature and residence times to obtain predetermined ratios of products. Coked sand residue from the fluidized bed is burned to produce the hot, burnt sand, a portion of which may be recycled to provide heat to the fluidized bed. Coked sand may also be recycled into a known, hot-water, caustic separation process where it synergistically improves the separation efficiency of the hot-water, caustic separation process.

14 Claims, 5 Drawing Figures

PROCESS FOR OBTAINING PRODUCTS FROM TAR SAND

BACKGROUND

1. Field of the Invention

This invention relates to a process for recovering bitumen from tar sand and, more particularly, to a combination hot-water and thermal process utilizing a fluidized bed to separate products and to produce a coked sand, a portion of which may be recycled into the hot-water process as well as through the fluidized bed.

2. The Prior Art

The term "tar sand" refers to a consolidated mixture of bitumen (tar) and sand. Alternate names for tar sands are "oil sands" and "bituminous sands", the latter term being more technically correct in that the sense of the term provides an adequate description of the mixture. The sand constituent of tar sand is mostly alpha quartz, as determined from x-ray diffraction patterns, while the bitumen or tar constituent of the tar sands consists of a mixture of a variety of hydrocarbons and heterocyclic compounds. This bitumen, if properly separated from the sands, may be upgraded to a synthetic crude oil suitable for use as a feedstock for the production of liquid motor fuels, heating oil, and/or petrochemicals.

About 65 percent of all of the known oil in the world is contained in tar sand deposits or heavy oil deposits. Tar sand fields occur throughout the world with the exception of the continents of Australia and Antartica. Significantly large tar sand deposits have been identified and mapped in Canada, Columbia, Trinidad-Tobago, Venezuela, and the United States. The Canadian tar sand deposits, known as the Athabasca tar sands, are located in the province of Alberta, Canada and are currently being developed. The estimated reserves for the bitumen content in the Athabasca tar sands alone has been estimated to be approximately 900 billion barrels. In the United States, approximately 24 states contain known tar sand deposits, although about 90 to 95 percent of the mapped tar sand deposits are located within the State of Utah and are estimated to include at least 25 billion barrels of oil. While the Utah tar sand reserves appear small in comparison with the enormous potential of the Athabasca tar sands, the Utah tar sand reserves represent a significant energy resource when compared to the United States crude oil proven reserves (approximately 31.3 billion barrels) and with the United States crude oil production of almost 3.0 billion barrels during 1976.

Utah tar sand deposits occur in six major locations along the eastern edge of the State with the bitumen content varying from deposit to deposit as well as within a given deposit. Current information available indicates that Utah tar sand deposits average generally less than 10 percent bitumen (by weight), although deposits have been found with a bitumen saturation of up to about 17 percent (by weight). Unlike Athabasca tar sands, however, Utah tar sands are characterized by the absence of connate water. In the absence of connate water, it is obvious that the bitumen is directly in contact with and bonded to the surface of the sand grains. Tests have also determined that the bitumen of Utah tar sands is at least one order of magnitude or at least ten times more viscous than bitumen obtained from Athabasca tar sands. Accordingly, the processing of Utah tar sands involves both displacement of the bonded bitumen from the sand grains followed by subsequent phase disengagement of the more viscous bitumen from the residual sand phase. Attempts to use conventional hot water processes that have been successfully applied to the Athabasca tar sands have been unsuccessful for processing Utah tar sands. This failure is readily apparent in light of the recognized differences in both the physical and chemical nature of the Utah tar sands.

A more comprehensive discussion of the Athabasca tar sands may be found in the literature including, for example, (1) E. D. Innes and J. V. D. Tear, "Canada's First Commercial Tar Sand Development," Proceedings of the Seventh World Petroleum Congress, Elsevier Publishing Co., 3, p. 633, (1967); (2) F. W. Camp, *The Tar Sands of Alberta Canada*, 2nd Edition, Cameron Engineering, Inc., Denver, Colo. (1974); and (3) J. Leja and C. W. Bowman, "Application of Thermodynamics to the Athabasca Tar Sands," *Canadian Journal of Chemical Engineering*, 46 p. 479 (1968).

Additionally, the following U.S. Patents are a few of the patents which have been granted for apparatus or processes directed toward obtaining bitumen from tar sands: U.S. Pat. Nos. 1,497,607; 1,514,113; 1,820,917; 2,871,180; 2,903,407; 2,927,007; 2,965,557; 3,159,562; 3,161,581; 3,392,105; 3,401,110; 3,553,099; 3,560,371; 3,556,980; 3,605,975; 3,784,464; 3,847,789; 3,875,046; 3,893,907; and 4,120,776. With the exception of U.S. Pat. Nos. 3,605,975 and 4,120,776, a coinventor of which is also a coinventor herein, each of the foregoing patents have been directed toward processing Athabasca tar sands and, as indicated hereinbefore, are believed not directly applicable to processing Utah tar sands.

The latter patent, U.S. Pat. No. 4,120,776, discloses a hot-water/caustic process for recovering bitumen from Utah tar sands. Greater than 95 percent of the bitumen was recovered in a concentrate which typically analyzed on the order of about 65 percent bitumen for single-stage processing. The sand tails were relatively free of bitumen. Accordingly, as set forth in this patent, the recovered, high-bitumen content concentrate would require additional upgrading before it can be successfully used in a refining process. It would, therefore, be a significant advancement in the art to incorporate the foregoing process in a process which upgrades the bitumen-rich concentrate to readily adapt the same for further processing and/or transfer by pipeline. It would also be an advancement in the art to provide a novel thermal process wherein a portion of the coked sand is recycled into the hot-water system to provide improvements in phase disengagement of the bitumen and also to transfer thermal energy to the hot-water system. Such a novel process is disclosed and claimed herein.

BRIEF SUMMARY AND OBJECTS OF THE INVENTION

This invention relates to a novel combination hot-water and thermal process for producing a product including hydrocarbons from tar sands. The products range from lower molecular weight gases to a synthetic crude. The process includes a fluidized bed, a combustor system, and sand recycle systems for both coked and burnt sand. The product is produced in the fluidized bed while coke residue on a portion of the coked sand from the fluidized bed is burned in a combustor system to produce thermal energy. Some of this thermal energy is returned to the fluidized bed with a portion of the burnt sand in the burnt sand recycle system. Coked sand is recycled into the hot-water/caustic system where it surprisingly improves the operating efficiency of the system by synergistically assisting in the phase disengagement of the bitumen from the sand. The combination hot-water and thermal process provides the additional advantage in that it is easier to obtain a good distribution of bitumen concentrate in the feed since the bitumen from the hot-water separation system is pumpable and, therefore, mixes better with the feed.

It is, therefore, a primary object of this invention to provide improvements in the process for producing products from Utah tar sands.

Another object of this invention is to provide a novel process for improving the separation of bitumen from Utah tar sands.

Another object of this invention is to provide a novel fluidized bed process for upgrading bitumen-rich concentrates into products.

These and other objects and features of the present invention will become more fully apparent from the following description and appended claims taken in conjunction with the accompanying drawing.

DETAILED DESCRIPTION OF THE PREFERRED EMBODIMENTS

Figure 1:
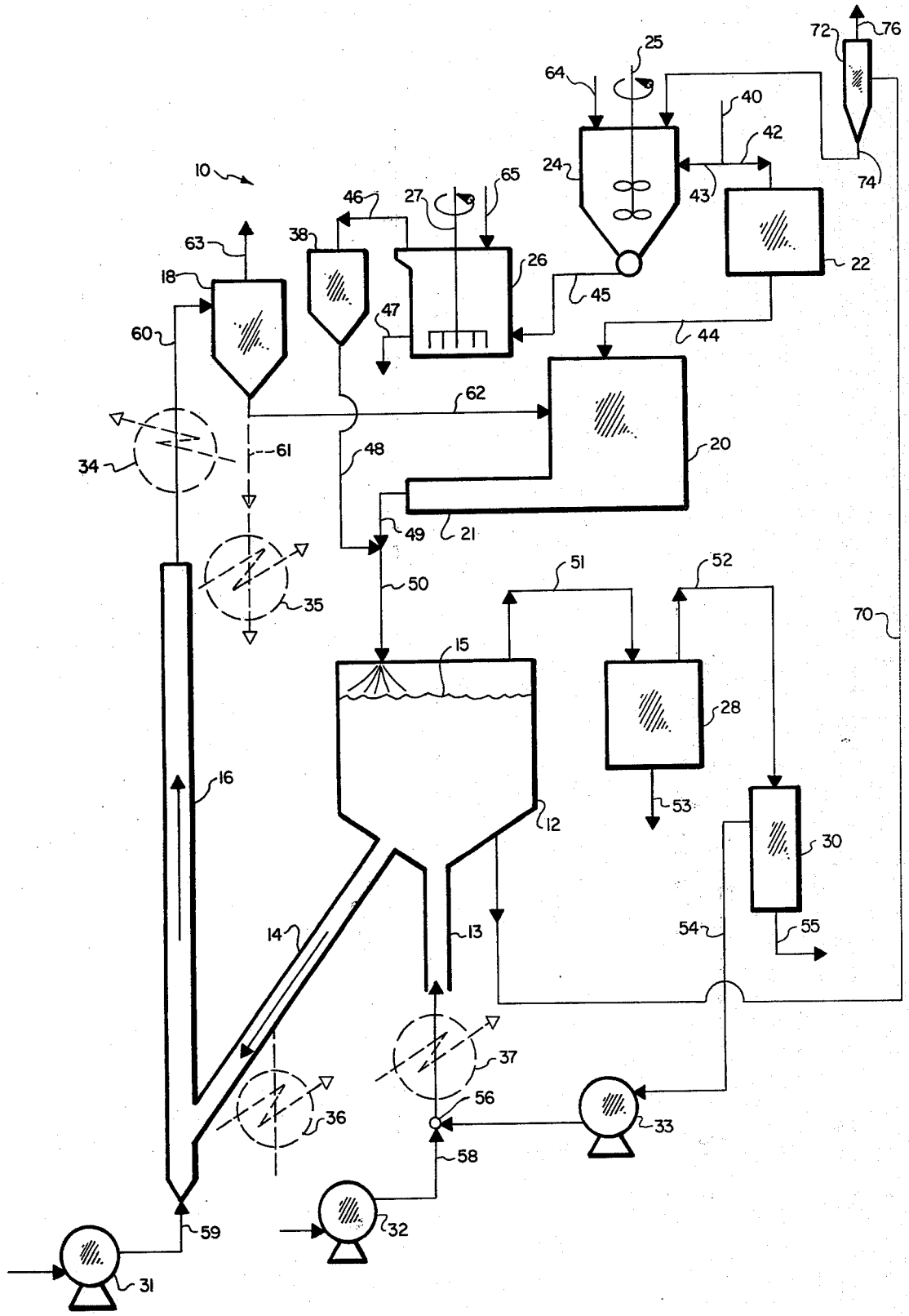
FIG. 1 is a schematic flow diagram illustrating one presently preferred embodiment for the process of the present invention.

The invention is best understood by reference to the drawing wherein like parts are designated with like numerals throughout.

General Discussion

The absence of a water film (connate water) between the bitumen and the sand particles in the tar sands of Utah along with the occurrence of most deposits being in the form of consolidated sandstones, led to the speculation that the fluidization characteristics of Utah tar sands as well as the synthetic crude yield and quality may be considerably different than might otherwise be expected when processing Canadian tar sands in a fluidized bed coking unit. Research reported in the literature has disclosed the use of a fluidized bed technique to recover a synthetic crude from the Athabasca tar sands. The results of the foregoing research were reported as follows: (1) Gishler, P. E. and Peterson, W. S., Canad. Oil Gas Ind. 3, 26 (1949); (2) Peterson, W. S., and Gishler, P. E., Canad. J. Res. 28, 62 (1950); and (3) Peterson, W. S., and Gishler, P. E., Pet. Eng. 23 66 (1951). There have been no reports in the literature on the thermal recovery of synthetic crudes by a fluidized bed technique for the tar sands of Utah.

The pilot plant for the research leading to this invention included a fluidized bed coker coupled with a riser combustor in which the coke on the sand was burned. The hot sand from the combustor was recycled to the fluidizing bed as a heat carrier. The synthetic crude obtained by this process had an API gravity of 15 to 16 whereas the bitumen extracted by the hot water technique had an API gravity of 7 to 8. The liquid yields were reported to be 70–80 percent (by weight—based upon the bitumen fed to the process).

A bench-scale investigation of the direct coking of an Athabasca tar sand has also been reported in the literature. The data reported was directed to a 679° K. end point. The yields of coke, gas, and naptha increased at the expense of heavy gas-oil with increasing coking bed temperature. The bitumen converted to coke increased with coking bed temperature up to 773° K. Above 773° K., the coke yield stabilized at approximately 20 percent (by weight) based upon bitumen feed. The light gas, naptha, and coke yields increase at the expense of heavy gas oil as the vapor residence time in the coking zone increased. It was also concluded from this investigation that the yield of synthetic crude and the quality of the liquid produced were independent of the residence time of the sand in the coking zone. See, Filby, J. E., Flynn, P. C., and Porteous, K. C., 27th Canad. Chem. Eng. Conf., Oil Sands Symp., Calgary, Alberta, Canada, Oct. 23–27, (1977).

Another investigation used a fluidized bed coker to recover a synthetic crude from the Kirmaku tar sands. The sand was crushed to less than 1 centimeter diameter particles and fed to a fluidized bed reactor held at 733°–753° K. The process yielded two percent (by weight) gas and 50–55 percent (by weight) synthetic crude based on the oil-soluble bitumen on the sand. The balance was converted to coke which was burned to supply the thermal energy needed to liberate the synthetic crude. The liquid yield appeared to be insensitive to the sand residence time in this investigation, that is, the combined (gas plus liquid) yield of the hydrocarbon was 53.6 percent (by weight) of bitumen fed at a sand residence time of 14.8 minutes and a coking temperature of 738° K., and it was 52.3 percent (by weight) at a sand residence time of 8 minutes and a coking temperature of 773° K. See, Safonov, V. A., Indyukov, N. M., Loginova, S. M., and Shevtsov, I. S., Sb. Tr. Inst. Nabtekhim Protssov, Akad. Nauk Azerb. SSR #4, 272 (1959); and Safanov, V. A., Indyukov, N. M., Shevtsov, I. S., Markaryan, S. M., and Rustamov, M. I., Sb. Tr. Azer-Nauch.-Issledovatel. Inst. Neft. Prom. im. V. V., Kurbysheva #2,288 (1958).

Experimentally, the process of the present invention centered around a thermal reactor wherein a precoked sand was fluidized and the reactor brought to the desired coking temperature while the hydrodynamic and thermal stability within the reactor was established in the fluidized bed. A nitrogen flow rate was used as the fluidizing medium by being introduced at the bottom of the reactor assembly and passed through a calming section where it was preheated to the coking temperature. Particles of pre-sized tar sand were fed to the reactor from a storage hopper by means of a screw feeder. Experimentally, thermal energy was supplied to the systems by electrical resistance heaters. The nitrogen-synthetic crude vapor mixture passed from the reactor into an expansion chamber where the vapor and entrained sand particles disengaged. Additional entrained sand fines were removed by cyclone separators and the remaining nitrogen-synthetic crude vapor mixture was passed through a fine mesh filter prior to being directed into the product recovery system. The cyclone separators and filter were maintained at 693 K. and 653 K., respectively, to inhibit condensation of the vapor. The product recovery train consisted of a water-cooled condenser, a cyclone, and a series of fiber mist absorbers maintained at ambient temperature. The synthetic crude thus obtained was absorbed by cellulose fibers in the filters and was stripped from the fibers by suitable solvents such as benzene, toluene, etc., while the non-condensable, non-absorbable, light hydrocarbon gases were chromatographically analyzed, metered, and then vented. The percent recovery ranged between 92 and 99 percent (by weight).

TABLE I

Effect of Temperature on Yield and Product Distribution Sunnyside Feed

| Experiment Number | 56 | 52 | 54 | 53 | 55 |
|---|---|---|---|---|---|
| Coking Reactor Temperature, K | 698 | 723 | 748 | 773 | 798 |
| Retention Time of Solids, min. | 27.2 | 27.2 | 27.2 | 27.2 | 27.2 |
| Feed Sand Particle Size, microns | 358.5 | 358.5 | 358.5 | 358.5 | 358.5 |
| Gas Make, LPH at STP | 7.3 | 7.3 | 10.6 | 14.5 | 16.0 |
| Synthetic Crude Yield, gm/hr | 19.8 | 23.9 | 18.4 | 22.2 | 22.9 |
| Mass Balance (Weight Percent) | | | | | |
| $CO_2$ | 1.2 | 1.3 | 1.8 | 1.5 | 2.7 |
| $C_1$-$C_3$ | 12.5 | 10.8 | 18.1 | 21.0 | 22.9 |
| $C_4$ | 4.1 | 4.0 | 5.9 | 6.5 | 6.7 |
| $C_5$ + Liquid | 51.0 | 61.2 | 55.1 | 47.5 | 45.0 |
| Coke | 31.2 (15.8)* | 22.6 | 19.2 | 23.5 | 22.8 |

*Weight percent of soft coke determined by solvent extraction.

Effect of Temperature on Product Yield and Distribution

Figure 2:
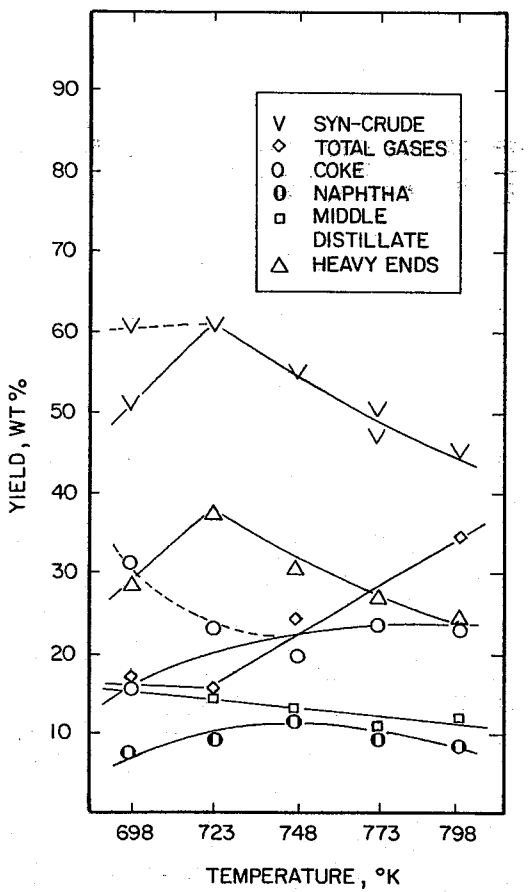
FIG. 2 is a diagram comparing the effect of reactor temperature on product yield and distribution for a tar sand feed obtained from the Sunnyside deposit of Utah tar sands.

The yields of light gas ($C_1$-$C_4$), naptha ($C_5$−478 K.), middle distillate (478–617 K.), heavy gas oil (617 K.+), total synthetic crude ($C_5$+), and coke are presented in FIG. 2 and Table 1 as a function of the coking bed temperature. All yields are reported as weight percent based on the bitumen fed. The base operating conditions for the investigation were atmospheric pressure, a solids retention time of 27.2 minutes, a sand feed particle size of 358.5 microns and a coking bed temperature of 773 K.

The yields of the $C_5$+ liquid passed through a maximum with temperature (61.2 wt % at 723 K.), however, at the lower temperature (698 K.) a solvent extractable liquid ("soft" coke) remained on the sand particles with the coked bitumen (non-extractable "hard" coke). If this liquid is considered as unliberated synthetic crude then the $C_5$+ liquid yield generally decreased with increasing temperature (dashed line, FIG. 2).

The "hard" coke yield increased with increasing temperature up to 723 K. and remained approximately constant at 19–23% by weight based on bitumen fed above 723 K. A similar trend was observed by Filby, ibid., and despite the chemical differences in the natures of the Canadian and Utah sands and in the coking bed temperatures the weight percent bitumen converted to coke was about the same in both investigations.

The light gas production increased with increasing temperature at the expense of the 617 K.+heavy gas oil, however, the increase in naphtha reported by Filby ibid., was not observed with the Utah tar sands. This may be due in part to the difference in the chemical nature of the Canadian and Utah sands, or to the differences in operating conditions. The carbon dioxide in the light gas is believed to have been produced by the decomposition of carbonates in the sand matrix.

TABLE 2

Properties of Synthetic Crude from Sunnyside Bituminous Sand

| | | | | | | | | | |
|---|---|---|---|---|---|---|---|---|---|
| Coking Reactor Temperature, K | | | | 723 | | 748 | | 773 | |
| Retention Time of Solids, min. | | | | 27.2 | | 27.2 | | 27.2 | |
| Feed Sand Particle Size, microns | | | | 358.5 | | 358.5 | | 358.5 | |
| Property | | | | | | | | | |
| Gravity, °API at 293 K | | | | 17.45 | | 14.92 | | 12.69 | |
| Viscosity, Centipose at 298 K | | | | 198 + 4 | | 133 ± 2 | | 81 + 1 | |
| Conradson Carbon, (wt %) | | | | 3.2 | | 5.3 | | 7.3 | |
| | | Extracted Bitumen | | Synthetic Crudes | | | | | |
| Temperature, K | | 353 | | 723 | | 748 | | 773 | |
| Fraction | Cut Point °C. | % Total | % Cumulative | % Total | % Cumulative | % Total | % Cumulative | % Total | % Cumulative |
| 1–7 | 200 | 0.91 | 0.91 | 3.25 | 3.25 | 3.45 | 3.45 | 4.71 | 4.71 |
| 8 | 225 | 0.21 | 1.12 | 2.81 | 6.07 | 3.37 | 6.82 | 3.56 | 8.27 |
| 9 | 250 | 0.49 | 1.61 | 3.52 | 9.59 | 4.07 | 10.89 | 4.73 | 13.00 |
| 10 | 275 | 0.79 | 2.40 | 4.92 | 14.51 | 5.42 | 16.31 | 5.43 | 18.43 |
| 11 | 305 | 1.30 | 3.70 | 6.44 | 20.94 | 6.51 | 22.82 | 5.92 | 24.35 |
| 12 | 335 | 1.93 | 5.63 | 7.04 | 27.98 | 6.79 | 29.61 | 6.13 | 30.48 |
| 13 | 365 | 2.81 | 8.44 | 7.78 | 35.76 | 7.72 | 37.33 | 6.43 | 36.91 |
| 14 | 395 | 3.23 | 11.67 | 8.27 | 44.03 | 7.47 | 44.80 | 6.58 | 43.49 |
| 15 | 425 | 3.49 | 15.16 | 9.04 | 53.07 | 8.08 | 52.88 | 6.95 | 50.44 |
| 16 | 455 | 4.62 | 19.78 | 9.38 | 62.45 | 7.96 | 60.84 | 6.78 | 57.22 |
| 17 | 485 | 5.71 | 25.49 | 10.82 | 73.27 | 8.62 | 69.46 | 7.33 | 64.55 |
| 18 | 515 | 4.29 | 29.78 | 9.14 | 82.41 | 7.22 | 76.68 | 6.70 | 71.25 |
| 19 | 538 | 2.66 | 32.44 | 6.35 | 88.76 | 5.19 | 81.87 | 4.50 | 75.75 |
| Residue | | 67.56 | 100.00 | 11.24 | 100.00 | 18.13 | 100.00 | 24.25 | 100.00 |

Effect of Temperature on Product Quality

Selected physical properties of the extracted bitumen and the effect of the reactor temperature on the physical properties of the synthetic crudes are presented in Table 2. The API gravity of the liquid decreased with increasing coking reactor temperature concomitant with an increase in the Conradson carbon residue. A marked decrease in the synthetic crude viscosity was observed as the coking reactor temperature increased. The simulated distillation data are discussed in terms of an 813 K. (540° C.) cut point. The amount of liquid boiling below 813 K. (540° C.) is greater at the lower coking reactor temperature and decreases with increasing temperature. The liquid boiling point below 638 K. (365° C.) increases with increasing coking reactor temperature, an indication that the hydrocarbon species boiling above 698 K. (425° C.) are undergoing thermal cracking at the higher reactor temperatures.

TABLE 3

Effect of Solids Retention Time on the Yield and Product Distribution
Sunnyside Feed

| Experiment Number | 68 | 52 | 61 | 66 | 53 | 64 | 67 | 55 | 65 |
|---|---|---|---|---|---|---|---|---|---|
| Coking Bed Temperature, K | 723 | 723 | 723 | 773 | 773 | 773 | 798 | 798 | 798 |
| Retention Time of Solids, min. | 31.4 | 27.2 | 20.4 | 31.4 | 27.2 | 20.4 | 31.4 | 27.2 | 20.4 |
| Feed Sand Particle Size, microns | 358.5 | 358.5 | 358.5 | 358.5 | 358.5 | 358.5 | 358.5 | 358.5 | 358.5 |
| Gas Make, LPH at STP | 9.3 | 7.3 | 7.7 | 15.9 | 14.5 | 9.0 | 14.3 | 16.0 | 12.2 |
| Synthetic Crude Yield, gm/hr | 25.1 | 23.9 | 32.6 | 23.1 | 22.2 | 44.0 | 22.8 | 22.9 | 41.1 |
| Mass Balance (Weight Percent) | | | | | | | | | |
| $CO_2$ | 2.3 | 1.3 | 0.9 | 2.8 | 1.5 | 1.3 | 5.2 | 2.7 | 1.6 |
| $C_1$-$C_3$ | 15.2 | 10.8 | 8.3 | 26.8 | 21.0 | 8.7 | 23.3 | 22.9 | 11.8 |
| $C_4$ | 4.3 | 4.0 | 2.6 | 8.0 | 6.5 | 2.6 | 6.8 | 6.7 | 4.1 |
| $C_5$ + Liquid | 55.8 | 61.2 | 50.4 | 42.8 | 47.5 | 67.4 | 42.2 | 45.0 | 61.8 |
| Coke | 22.5 | 22.6 | 37.9 (20.9)* | 19.7 | 23.5 | 20.0 | 22.5 | 22.8 | 20.6 |

*Weight percent of soft coke determined by solvent extraction.

Effect of Solids Retention Time on Yield

The solids retention time ($\theta$, minutes) was defined as $$\theta = 60\ W/F$$

where W is the weight of solids in the bed, kg, and F is the sand feed rate, kg $H^{-1}$. In this investigation, the retention time was varied by increasing or decreasing the sand feed rate while keeping the bed height and mass constant. The effect of solid retention time on the synthetic crude yield and coke make is presented in Table 3 and FIGS. 3 through 5. The amount of coke produced (19–23% by weight of bitumen fed) was relatively insensitive to changes in the solids retention time.

Figure 3:
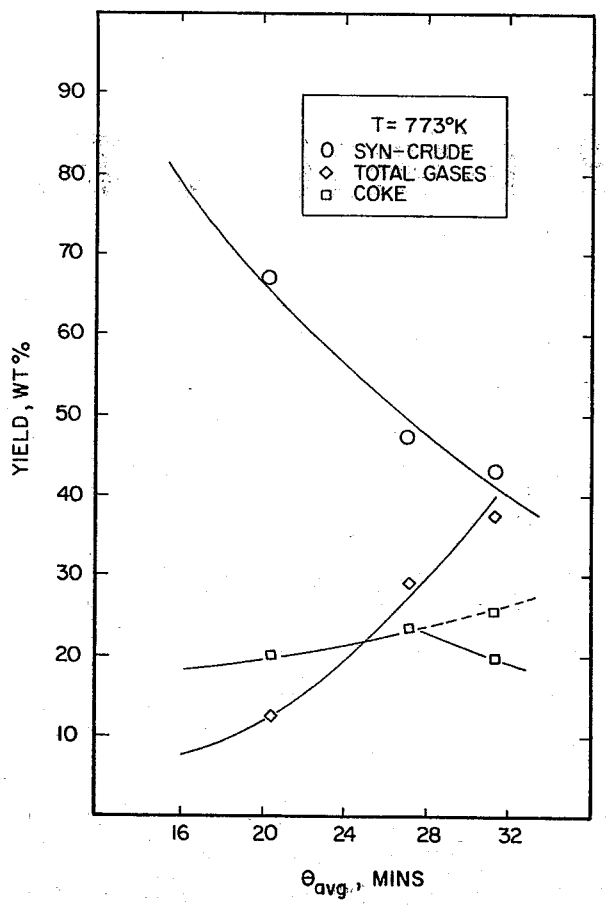
FIG. 3 is a diagram comparing the effect of retention time of solids on the yield pattern for a tar sand feed obtained from the Sunnyside deposit of the Utah tar sands.
Figure 5:
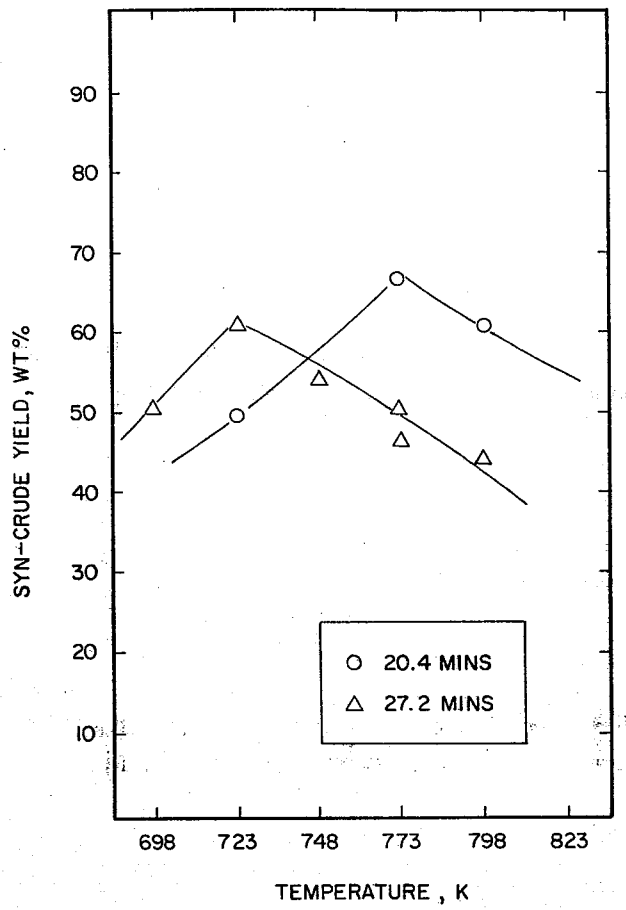
FIG. 5 is a diagram comparing the effect of retention time on the optimum temperature for maximum yield of synthetic crude.
Figure 4:
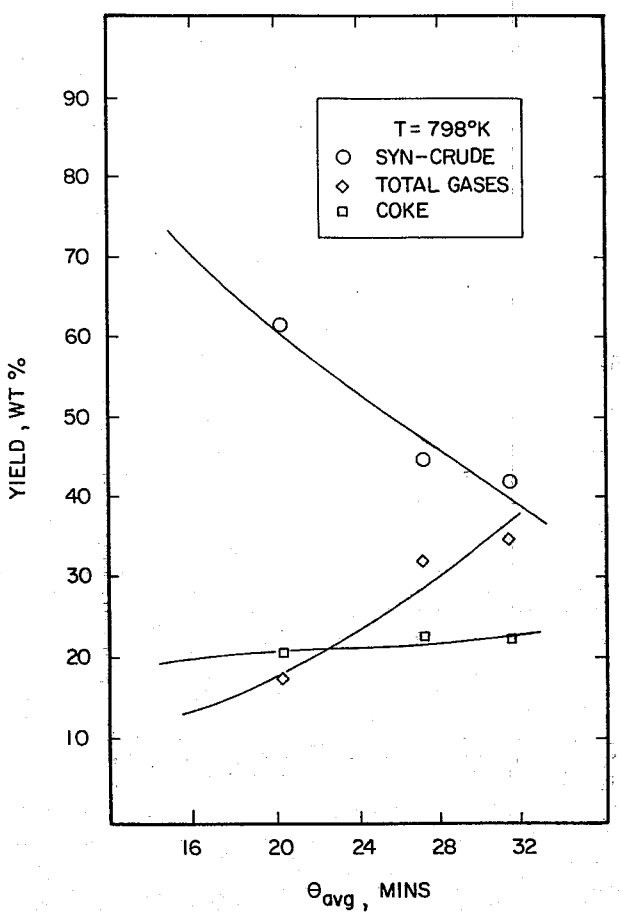
FIG. 4 is a diagram comparing the effect of retention time of solids on the yield pattern for tar sands obtained from the Sunnyside deposit of Utah tar sands at a reaction temperature of 798° K.

The yield of synthetic crude decreased with increasing retention time and the yield of light gas increased with increasing retention time at each temperature studied (FIGS. 3 and 4). The increased solids retention time would appear to increase the residence time of the liberated hydrocarbon vapor in the coking zone thus leading to more extensive thermal cracking of the vapor. Decreasing the solids retention time shifted the temperature at which the maximum liquid yield was obtained and increased the yield of liquid at the maximum temperature (FIG. 5). At a retention time of 20.4 minutes the maximum liquid yield was 67.4% (by weight) at 773 K. whereas at a retention time of 27.2 minutes the maximum yield was 61.2% (by weight) at 773 K.

Retention times below 20 minutes were not investigated due to a limitation in the reactor throughput capacity. If we can reasonably extrapolate the data obtained in this investigation, a liquid yield of 80% (by weight), of bitumen fed would be obtained at a coking reactor temperature of 773 K. with a solids retention time of 16 minutes.

TABLE 4

Effects of Feed Particle Size on Yield and Product Distribution
Sunnyside Feed

| Experiment Number | 71 | 64 | 69 | 59 |
|---|---|---|---|---|
| Coking Bed Temperature, K | 773 | 773 | 773 | 773 |
| Retention Time of Solids, $_{avg}$, min. | 20.4 | 20.4 | 20.4 | 25.5 |
| Feed Sand Particle Size, microns | 253.5 | 358.5 | 507.5 | 162.0 |
| Rate of Bitumen Feed to Reactor, gm/hr | 75.5 | 82.8 | 91.0 | 76.5 |
| Gas Make, LPH at STP | 9.2 | 9.0 | 21.9 | 11.9 |
| Synthetic Crude Yield, gm/hr | 40.8 | 44.0 | 40.6 | 32.0 |
| Mass Balance (Weight Percent) | | | | |
| $CO_2$ | 2.3 | 1.3 | 2.3 | 1.3 |
| $C_1$-$C_3$ | 9.7 | 8.7 | 20.6 | 13.6 |
| $C_4$ | 2.9 | 2.6 | 6.1 | 4.3 |
| $C_5$ + Liquid | 65.1 | 67.4 | 51.8 | 63.5 |
| Coke | 20.0 | 20.0 | 19.2 | 17.4 |

Effect of Particle Size and Particle Size Distribution on Yield

The effects of particle size and particle size distribution of the feed sand on the yield and product distribution are presented in Table 4. The particle size data were acquired at a coking bed temperature of 773 K. and a solids retention time of 20.4 minutes. A reduction in sand particle size from 358.5 microns to 253.5 microns had little or no effect on the liquid yield and on the product distribution. However, a significant shift in product distribution was observed when the sand particle size was increased from 358.5 microns to 507.5 microns. The light gas yield increased from 11.3 to 26.7% (by weight of bitumen fed) while the $C_5$+ liquid yield decreased from 67.4 to 51.8% (by weight). Thus a substantial portion of the $C_5$+ hydrocarbon was thermally cracked to lighter species, in particular, $C_1$-$C_3$ gases. As set forth hereinbefore, we here speculate that the conversion to lighter species may be related to a higher residence time phenomena.

A single experiment was made with a wide cut feed sand (Tyler Sieve: 20–150 mesh fraction) to determine the effect of the sand size distribution on the liquid yield. The yield was similar to that obtained with the smaller feed sand particles, that is, 63.5% (by weight) liquid and 17.9% (by weight) $C_1$–$C_4$ gases. A size distribution analysis on the sand indicated that 65% of the feed sand was finer than 358.5 microns and it would be expected to exhibit yields more nearly like the smaller feed sand particles (approx. 358.5 microns) than like the larger particles (approx. 507.5 microns).

A larger sand particle distribution in the bitumen concentrate and also, therefore, in the feed to the fluidized bed may be obtained through recycling a portion of the coke sand from the fluidized bed to the hot-water separation system. The coked sand is obtained directly from the fluidized bed and either introduced directly into the digester or subjected to a preliminary screening process to further enhance the recycling of larger sand particles. Coming from the fluidized bed, the coked sand is hot and, therefore, transmits this sensible heat to the hot-water separation system.

More importantly and surprisingly, improved separation efficiency is obtained in the hot-water separation system through the recycling of hot, coked sand into the hot-water system. While the exact phenomena of the surprising result is not clearly understood, it is postulated that, since the coked sand has a carbon residue thereon which renders the coked sand hydrophobic as well as oleophilic (having an affinity for oils, etc.), the coked sand synergistically cooperates with the tar sand in phase disengagement of the bitumen from the sand. It is also currently believed that a coarser sand particle in the coked sand contributes to the separation efficiency by displacing finer sand particles in the tar sand feed with the coarser, coked sand. As a result of this latter phenomena, the bitumen concentrate includes a higher ratio of coarser sand particles which, in turn, contribute to an improved thermal processing in the fluidized bed in terms of separation.

Referring now more particularly to FIG. 1, a schematic illustration of a first preferred embodiment of the novel process of this invention is shown generally at 10 and includes a thermal reactor 12 receiving a tar sand feed 50 and discharging coked sand residue either through a standpipe 14 into a riser combustor 16 or as coked sand 70 destined as recycled, coked sand for the hot-water system as will be described hereinafter. Reactor 12 contains a fluidized bed 15 of tar sand with fluidizing gas being injected through inlet riser 13 and mixing valve 56 from a recycle compressor 33 and a makeup gas 58 from a compressor 32. Tar sand feed 50 is obtained from a mixture of tar sand and/or bitumen concentrate 48 from the hot-water system (to be set forth more fully hereinafter) and a mixed feed 49 from a feed mixer 20. Mixed feed 49 includes burnt sand 62 and undigested tar sand 44.

Incoming tar sand 40 from the mining operation (not shown) is split as tar sand feed 43 directed to a digester 24 or as tar sand feed 42 into a feed preparation 22. Caustic and water are introduced into digester 24 through inlet 64 and the resulting tar sand/water-caustic slurry is agitated by rotation of agitator 25. The digested tar sand slurry 45 is then directed to separation cell 26. Air is introduced into the bottom of separation cell 26 through a rotating sparger system 27 and, in combination with a diluent water injected through inlet 65, results in a concentrated bitumen 46 being directed into a concentrate storage vessel 38. Cleansed sand 47 is discharged from separation cell 26 and transferred back to the mine (not shown) as fill. The process involving digester 24 and separation cell 26 is substantially described in U.S. Pat. No. 4,120,776 and, as set forth hereinbefore, the resulting product, concentrate 46, has a relatively high bitumen concentrate with a significant residual sand content while the discharged sand 47 is relatively clean.

As set forth hereinbefore, surprising improvements in the phase disengagement step of digester 24 is obtained by recycling hot, coked sand (either coked sand 70 or coarse, coked sand 74) from reactor 12 into digester 24. Coked sand 70 may be recycled directly into digester 24 or, as shown, subjected to a separation step in a separator 72 to produce coarse, coked sand 74 and coked fines 76 which may be returned to the combustor 16. In either circumstance, surprisingly improved separation efficiencies are experienced in digester 24.

Hot, burnt sand 62 is mixed with undigested tar sand in feed mixer 20 and extruded through extruder 21 to join bitumen concentrate 48 to form feed 5 to the fluidized bed, thermal reactor 12. As set forth hereinbefore, the fluidized bed is maintained and the bitumen constituent of the tar sand is substantially volatilized and removed as raw product 51 to a gas/liquid separator 28. The liquid 53 separated from gas/liquid separator 28 is drawn off as a synthetic crude product while the residual gases 52, including both lighter hydrocarbons and combustion products as well as inert gases, are directed to a knockout drum 30 where additional condensate 55 is drawn off. The remaining gas 54 is recycled through recycle compressor 33 and mixing valve 56 into reactor 12.

The balance of coked sand residue from reactor 12 is drawn off through coked sand standpipe 14 and introduced into the riser combuster 16. Combustion air 59 is supplied by compressor 31 and provides the necessary combustion oxygen for burning of the residual coke on the coked sand while, simultaneously, lifting the resulting burnt sand, mixed burnt sand 60, upwardly into cyclone separator 18. Cyclone separator 18 removes fines 63 which are returned with sand 47 to the mine while burnt sand 62 is either recycled to mixer 20 or discharged through heat exchanger 35 as discharged, burnt sand 61 (shown in broken lines).

Advantageously, riser combuster 16 provides economies in operation in that the mechanical handling of hot burnt sand is effectively eliminated. However, while riser combuster 16 is shown herein, it should be particularly understood that any other suitable combustion system may be effectively utilized. For example, combustion of the coke on the coked sand may take place in a second fluidized bed and the resulting hot, burnt sand transported by a conventional air lift system (not shown).

The effect of temperature, retention times, and particle sizes for the fluidized bed of reactor 12 are clearly set forth hereinbefore. The careful adjustment of these variables allows the operator to readily predetermine the type and ratios of the products to be obtained from this process.

Heat exchangers 34–37 provide the necessary heat recovery or input as is conventional.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A process for recovering products from tar sand comprising:

obtaining a tar sand having a negligible amount of connate water;

preparing a tar sand feed from the tar sand, said tar sand feed comprising a bitumen-rich concentrate containing at least about 35% sand by weight;

recovering products from the tar sand feed by passing the tar sand feed into a fluidized bed while heating the tar sand feed in the fluidized bed;

removing a coked sand from the fluidized bed;

producing a hot, burnt sand by burning coke residue on the coked sand; and providing heat to the tar sand in the fluidized bed by recycling at least a portion of the hot, burnt sand.

2. The process defined in claim 1 wherein said tar sand feed is prepared by blending the bitumen-rich concentrate with tar sand to produce said tar sand feed.

3. The process defined in claim 1 further comprising the step of recycling at least a portion of the hot, burnt sand to the bitumen-rich concentrate and blending it therewith to produce said tar sand feed.

4. The process defined in claim 1 wherein the preparing step further comprises obtaining the bitumen-rich concentrate from a hot-water, caustic separation process and improving the separation efficiency of the hot-water, caustic separation process by recycling a portion of the coked sand to the hot-water, caustic separation process.

5. The process defined in claim 4 wherein the improving step further comprises separating coarser particles of coked sand from the coked sand and introducing the coarser particles of coked sand into the hot-water, caustic separation process.

6. The process defined in claim 1 wherein the recovering step further comprises selectively predetermining the product's composition by selectively adjusting the temperature and residence time for the tar sand feed in the fluidized bed.

7. The process defined in claim 1 wherein the preparing step further comprises obtaining the bitumen-rich concentrate from a hot-water, caustic separation process.

8. A process for producing products from tar sand comprising:

obtaining a tar sand having a negligible amount of connate water;

preparing a bitumen-rich concentrate from the tar sand, said bitumen-rich concentrate containing at least about 35% sand by weight;

heating the bitumen-rich concentrate by adding a hot, burnt sand to the bitumen-rich concentrate to produce a tar sand feed;

recovering products from the tar sand feed by passing the tar sand feed through a fluidized bed while controlling the temperature of the fluidized bed and the residence time of the tar sand feed in the fluidized bed while producing a coked sand; and producing the hot, burnt sand by burning the coke on the coked sand and recycling at least a portion of the hot, burnt sand in the heating step.

9. The process defined in claim 8 wherein the recovering step further comprises increasing the percentage of lower molecular weight species by selectively adjusting the residence time for the tar sand feed in the fluidized bed.

10. The process defined in claim 8 wherein the preparing step further comprises obtaining the bitumen-rich concentrate from a hot-water, caustic separation process.

11. The process defined in claim 10 wherein the preparing step further comprises increasing the separation efficiency of the hot-water, caustic separation process by recycling at least a portion of the coked sand from the fluidized bed into the hot-water, caustic separation process.

12. A process for recovering products from tar sand comprising:

obtaining a tar sand containing a negligible amount of connate water;

preparing a tar sand feed from the tar sand by recovering a bitumen-rich concentrate from the tar sand using a hot-water, caustic separation process;

recovering products from the tar sand feed by passing the tar sand feed into a fluidized bed while heating the tar sand in the fluidized bed;

removing a coked sand from the fluidized bed;

producing a hot, burnt sand by burning coke residue on the coked sand; and improving the separation efficiency of the hot-water, caustic separation process in said preparing step by recycling a portion of the coked sand to the hot-water, caustic separation process.

13. The process defined in claim 12 further comprising the step of recycling at least a portion of the hot, burnt sand to the bitumen-rich concentrate and blending it therewith to produce said tar sand feed.

14. The process defined in claim 12 further comprising the step of recycling at least a portion of the hot, burnt sand to the fluidized bed.

* * * * *

UNITED STATES PATENT AND TRADEMARK OFFICE

CERTIFICATE OF CORRECTION

PATENT NO. : 4,337,143

DATED : June 29, 1982

INVENTOR(S) : Hanson et al.

It is certified that error appears in the above-identified patent and that said Letters Patent are hereby corrected as shown below:

Column 5, line 66 "naptha" should be --naphtha--

Column 10, line 19 "5" should be --50--

Column 12, line 14 in Claim 8 "in" should be --to--

Signed and Sealed this

Nineteenth Day of October 1982

[SEAL]

Attest:

GERALD J. MOSSINGHOFF

Attesting Officer

Commissioner of Patents and Trademarks